US008628457B2

(12) United States Patent
Terlau

(10) Patent No.: US 8,628,457 B2
(45) Date of Patent: Jan. 14, 2014

(54) METHOD FOR FOLDING SHEETS

(75) Inventor: Martin Terlau, Murrhardt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 348 days.

(21) Appl. No.: 12/564,142

(22) Filed: Sep. 22, 2009

(65) Prior Publication Data

US 2010/0075821 A1 Mar. 25, 2010

(30) Foreign Application Priority Data

Sep. 22, 2008 (DE) ..... 10 2008 048 287

(51) Int. Cl.
*B65H 5/24* (2006.01)
*B65H 45/14* (2006.01)

(52) U.S. Cl.
USPC ..... 493/420; 271/149; 271/151

(58) Field of Classification Search
CPC ..... B65H 45/20; B65H 45/142; B65H 45/14
USPC ..... 493/413, 416, 417, 419, 420, 421, 443, 493/444, 445; 271/149, 151
IPC ..... B65H 5/24, 45/14
See application file for complete search history.

(56) References Cited

U.S. PATENT DOCUMENTS 2,253,446 A * 8/1941 Spiess ..... 493/360
3,975,009 A * 8/1976 Brown ..... 493/14
4,029,310 A * 6/1977 Reist ..... 493/426
4,534,550 A * 8/1985 Reist ..... 271/183
5,022,644 A * 6/1991 Burge ..... 271/270
5,042,792 A * 8/1991 Honegger et al. ..... 271/188
5,162,036 A * 11/1992 Peter et al. ..... 493/416
5,165,674 A * 11/1992 Petersen ..... 270/47
5,169,376 A * 12/1992 Ries et al. ..... 493/445
5,288,067 A * 2/1994 Stock ..... 271/276
5,399,222 A * 3/1995 Reist ..... 271/151
5,554,094 A * 9/1996 Viens ..... 493/421
5,738,620 A * 4/1998 Ebner et al. ..... 493/445
5,871,433 A * 2/1999 Lehmann et al. ..... 493/420
6,475,129 B1 * 11/2002 Lehmann ..... 493/421

(Continued)

FOREIGN PATENT DOCUMENTS

DE 2940360 A1 4/1981
DE 10105991 A1 8/2002

(Continued)

OTHER PUBLICATIONS

German Search Report dated Apr. 22, 2009, for application DE 102008048287.0, 4 pages.

*Primary Examiner* — Stephen F Gerrity
(74) *Attorney, Agent, or Firm* — Laurence A. Greenberg; Werner H. Stemer; Ralph E. Locher

(57) ABSTRACT

A folding machine and a method of folding sheets of paper, board and the like with underlapping, include at least a first folding station with folding units and an imbricated feeder for feeding sheets to the first folding station, over an aligning table, in a first transporting direction. The imbricated feeder has a device for separating the sheets and a suction configuration which can be adjusted in and counter to the first transporting direction and is intended for the underlapping transfer of sheets from a sheet stack of the imbricated feeder to the aligning table.

4 Claims, 7 Drawing Sheets

(56) References Cited

U.S. PATENT DOCUMENTS

| | | | | |
|---|---|---|---|---|
| 6,554,268 | B1 * | 4/2003 | Keller et al. | 271/11 |
| 6,743,161 | B2 * | 6/2004 | Dannemann et al. | 493/442 |
| 6,843,359 | B2 | 1/2005 | Ballestrazzi et al. | |
| 6,935,998 | B2 * | 8/2005 | Silvestre | 493/405 |
| 7,247,129 | B2 * | 7/2007 | Neubauer et al. | 493/421 |
| 7,757,461 | B2 * | 7/2010 | Honegger | 53/447 |
| 2004/0188931 | A1 * | 9/2004 | Leu | 271/264 |
| 2007/0096382 | A1 | 5/2007 | Komori | |
| 2007/0216082 | A1 * | 9/2007 | Fenile et al. | 271/69 |
| 2010/0093509 | A1 * | 4/2010 | Haller | 493/416 |

FOREIGN PATENT DOCUMENTS

| | | | |
|---|---|---|---|
| DE | 102004041471 | A1 | 4/2005 |
| DE | 10336757 | A1 | 2/2006 |
| DE | 102004058647 | A1 | 6/2006 |
| DE | 102006055301 | A1 | 5/2008 |
| EP | 1297969 | A2 | 4/2003 |
| EP | 1342683 | A2 | 9/2003 |
| EP | 1840059 | A1 | 10/2007 |
| GB | 437809 | A | 11/1935 |
| JP | 2002308468 | A | 10/2002 |

* cited by examiner

METHOD FOR FOLDING SHEETS

CROSS-REFERENCE TO RELATED APPLICATION

This application claims the priority, under 35 U.S.C. §119, of German Patent Application DE 10 2008 048 287.0, filed Sep. 22, 2008; the prior application is herewith incorporated by reference in its entirety.

BACKGROUND OF THE INVENTION

1. Field of the Invention

The invention relates to a method of folding sheet-like elements in a folding station of a folding machine, in which the folding station has at least one folding unit and the sheet-like elements are fed to the folding station in a transporting direction with their leading edge in front and with underlapping. The invention also relates to a folding machine for folding sheets of paper, board and the like, in particular for implementing the method according to the invention, having at least a first folding station, with at least one folding unit and an imbricated feeder for feeding sheets with underlapping to the first folding station over an aligning table, in a first transporting direction.

2. Description of the Related Art

The prior art discloses buckle folding machines. The construction of a buckle folding machine having a multiplicity of buckle folding units can be gathered from German Published, Non-Prosecuted Patent Application DE 10 2004 041 471 A1. A respective buckle folding unit thereof includes a buckle plate and three folding rollers disposed in two folding-roller pairs. Knife folding machines are also known. German Published, Non-Prosecuted Patent Application DE 29 40 360 A1 discloses a single knife folding unit for folding printed and pre-folded sheets. Combination folding machines combine buckle folding units and knife folding units. In a first folding station thereof, buckle folding units produce parallel folds and, in a following folding station, knife folding units produce cross folds. German Published, Non-Prosecuted Patent Application DE 10 2006 055 301 A1 discloses combination folding machines having a plurality of buckle folding units and knife folding units disposed thereafter.

In order to increase the output of folding machines, in other words the productivity thereof, the speed at which the sheets run through the folding machine is usually increased. By virtue of the speed being increased, however, a respective sheet undergoes deformation and damage, which results in the quality being significantly impaired.

German Published, Non-Prosecuted Patent Application DE 103 36 757 A1 discloses methods of folding sheets fed with imbricated overlapping. Using those methods is intended to increase the productivity of the folding machines without the speed at which the sheets run through the machine being increased. For that purpose, nips between folding rollers taking in the sheets are increased and/or decreased in sub-phases of a continuous folding operation in dependence on a folding cycle. Such a procedure is disadvantageous since adaptation of the nip requires complicated mechanical mounting of the folding rollers and also high-cost activation of the drives. A further disadvantage is that successive sheets meet in the folding units and are moved at a relative speed in relation to one another. The sheets may be damaged in that case, and that may result in so-called marking. The movement of the two sheets relative to one another may give rise to increased folding tolerances, electrostatic charging and disruptions in the region of a buckle-plate infeed.

SUMMARY OF THE INVENTION

It is accordingly an object of the invention to provide a method and a machine for folding sheets, which overcome the hereinafore-mentioned disadvantages of the heretofore-known methods and machines of this general type and which do not require any structural modifications to existing folding units.

With the foregoing and other objects in view there is provided, in accordance with the invention, a method of folding sheet-like elements in a folding machine having a folding station with at least one folding unit. The method comprises feeding the sheet-like elements to the folding station in a transporting direction with leading edges of the sheet-like elements in front and with underlapping, folding the sheet-like elements downward or under with a first folding length in the at least one folding unit, producing a fold transversely to the transporting direction and creating a first folded product, setting a spacing between the leading edge of a first folded sheet-like element and the leading edge of a following sheet-like element to be greater than or equal to zero in each case, and adjusting the underlapping to correspond at most to the first folding length.

The invention therefore relates to a method of folding sheet-like elements, in particular printed sheets of paper, board and the like, with underlapping in a folding machine. For this purpose, the folding machine has at least one folding station with at least one folding unit. The sheet-like elements are fed to the folding station in a transporting direction with their leading edge in front and with underlapping. The underlapping in this case corresponds, according to the invention, to not more than the first folding length. In the folding unit, a fold is produced transversely to the transporting direction in a respective sheet-like element and the sheet-like elements are folded downward with a first folding length, i.e. the leading edge of a respective sheet-like element is placed on the underside thereof. The fold in this case is such that the spacing between the placed-in-position leading edge of a first sheet-like element and the leading edge of a following, not-yet-folded sheet-like element is greater than or equal to zero. In other words, even following the first fold, the leading edges are spaced apart from one another or, in a borderline case, rest one upon the other. As seen in the transporting direction, it is thus the case that the leading edge of a first sheet-like element is located downstream of the leading edge of a following, not-yet-folded sheet-like element. This ensures that a first incoming sheet-like element and a subsequently incoming sheet-like element do not meet.

In accordance with another mode of the invention, the underlapping folding can be carried out in this case in a buckle folding station or a parallel knife folding station. The parallel knife folding station in this case has a bottom folding knife which acts from beneath. Following the underlapping folding described above, the resulting folded product can be processed further by further folding, be this in following folding units of the same folding station and/or in following folding stations.

In order to produce non-imbricated folding of sheets according to the prior art, there has to be a spacing of approximately 5 to 8 cm in each case between the sheets fed to a folding unit. As a result, the folding operation in the first folding unit has already been completed before a following sheet runs into the folding unit. Using the method according to the invention advantageously makes it possible to dispense with the spacing between sheets as they run into the folding station, with the sheets being moved along with underlapping. The underlapping of the sheets makes it possible, with the same speed and quality, to fold more sheets and the output of the folding machine is increased. There is no need in this case for the folding units to be adapted.

With the objects of the invention in view, there is also provided a folding machine for folding sheets of paper, board or the like, in particular for implementing the method according to the invention. The folding machine comprises at least a first folding station with at least one folding unit, an aligning table, and an imbricated feeder for feeding sheets with underlapping to the first folding station over the aligning table, in a first transporting direction. The imbricated feeder has a sheet stack, a device for separating the sheets, and a suction configuration to be adjusted in and counter to the first transporting direction for an underlapping transfer of sheets from the sheet stack to the aligning table. The suction configuration is adjustable for setting a degree of underlapping.

The invention therefore also relates to a folding machine for folding sheet-like elements such as sheets of paper, board and the like, having at least a first folding station and having an imbricated feeder. The first folding station has at least one folding unit. The imbricated feeder serves for the underlapping feed of sheet-like elements to the first folding station, over an aligning table, in a first transporting direction. The imbricated feeder has a device for separating the sheet-like elements and a suction configuration which can be adjusted in and counter to the first transporting direction. The degree of underlapping of the sheet-like elements can advantageously be set by adjustment of the suction configuration.

In accordance with another advantageous feature of the folding machine of the invention, the suction configuration is operated cyclically and the degree of underlapping can be changed by virtue of the cyclic timing being changed. Cyclic operation can be achieved in a manner known to a person skilled in the art by cyclic air feed and/or by a lifting movement of the suction configuration.

In accordance with a further advantageous feature of the folding machine of the invention, the device for separating the sheet-like elements is a suction head with a lifting sucker and blowing-air assistance. The suction configuration in this case may advantageously be constructed as a pull sucker or as a suction wheel.

In accordance with an added advantageous feature of the folding machine of the invention, the latter has transporting devices for transporting the sheet-like elements, for example conveying belts or angled roller tables. The feeder, the at least one folding station and the transporting devices are advantageously activated by a common control unit.

In accordance with an additional advantageous feature of the folding machine of the invention, the first folding station is followed by a second folding station disposed downstream thereof. This second folding station may have buckle folding units or knife folding units.

In accordance with yet another advantageous feature of the folding machine of the invention, a configuration for applying adhesive to the products is disposed upstream of at least one folding station.

In accordance with yet another advantageous feature of the folding machine of the invention, a configuration for trimming the products is disposed downstream of at least one folding station. The configuration for applying adhesive and the configuration for trimming the products advantageously make it possible to produce small books, so-called booklets, from the sheets.

In accordance with yet a further advantageous feature of the folding machine of the invention, a configuration for pressing the products is disposed downstream of at least one folding station. Pressing of the products advantageously makes it possible to prevent the products from bulging out.

Exemplary Embodiment

The method, according to the invention, of folding sheets of paper, board and the like with underlapping in a folding machine can be implemented, for example, as described hereinbelow:

In a first step, sheets are transported from an imbricated feeder to a first folding station, with buckle folding units, in a first transporting direction and fed to the folding station. The longer side of a respective sheet in this case is oriented parallel to the first transporting direction. The sheets are transported with underlapping and fed to the first folding station with underlapping. In other words, the upstream end of a first sheet covers over the downstream end of a following sheet. In the second step, folding takes place twice in the first folding station to produce first folded products. The folds are eccentric zigzag folds, zigzag/parallel folds or parallel folds with folds at equal spacings. In order to produce the first fold, the sheets each run into a bottom buckle plate. The first folded product can be transported further to a second folding station. There, further folding of the first folded product gives rise to a second folded product. The second folding station may be followed by a third folding station, in which the second folded product is folded further and a third folded product is produced.

Other features which are considered as characteristic for the invention are set forth in the appended claims.

Although the invention is illustrated and described herein as embodied in a method and a machine for folding sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
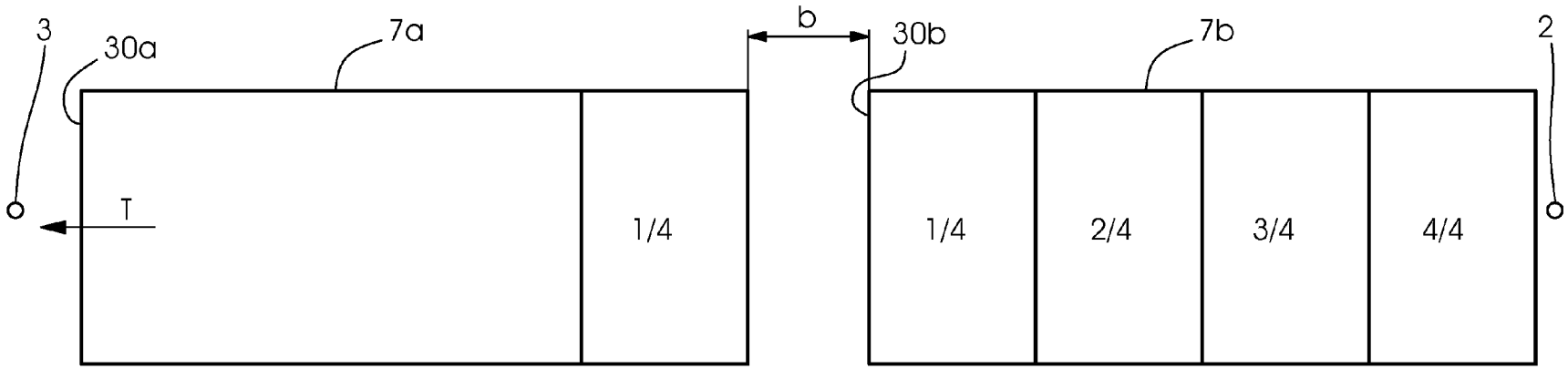
FIG. 1A is a diagrammatic, plan view showing two spaced-apart sheets.

Referring now to the figures of the drawings in detail and first, particularly, to FIG. 1A thereof, there are seen two sheet-like elements, in this case two sheets 7*a*, 7*b*, which are transported in a transporting direction T from a feeder 2 to a first folding station 3. A spacing b between the first sheet 7*a* and the second sheet 7*b* is usually in a range of from 5 to 8 cm. In the first folding station 3 which follows, the sheets 7*a* and 7*b* are folded three times, giving rise to sheet parts with the same dimensions. The sheet parts are noted in FIG. 1A indicating that the folds in the first folding station 3 divide a respective sheet 7*a*, 7*b* into four equal-sized parts.

Figure 1B:
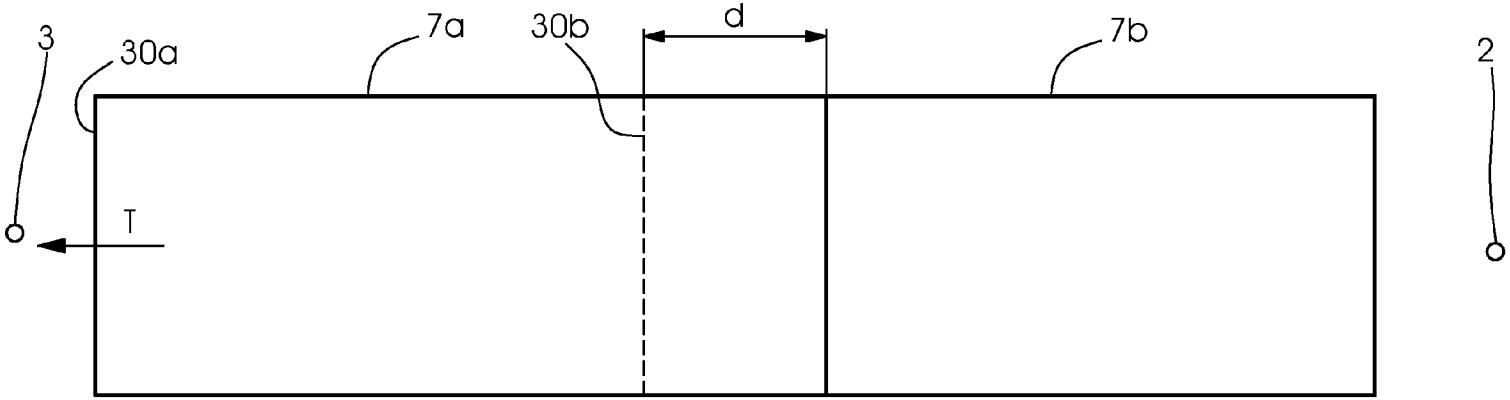
FIG. 1B is a plan view showing two sheets with underlapping.

FIG. 1B illustrates two sheets 7*a*, 7*b* which, coming from a feeder 2, are transported in the transporting direction T to a first folding station 3. The sheets 7*a* and 7*b* in this case are transported with underlapping d. The downstream end 30*b* of the sheet 7*b* is covered over by the first sheet 7*a*. In the example of FIG. 1B, three folds are produced, in which case a respective sheet 7*a*, 7*b* is divided into four equal sheet parts. The underlapping d is a quarter of the length of the sheets 7*a*, 7*b*. In contrast to the two sheets 7*a* and 7*b* being transported at a spacing apart from one another in FIG. 1A, in order to be transported with underlapping according to FIG. 1B, the second sheet 7*b* has been displaced in the transporting direction T by the sum of the sheet spacing b and underlapping d. The sheets 7*a*, 7*b* then have to cover a shorter distance in order to be folded in the first folding station 3. In other words, with the machine speed i.e. transporting speed, being the same, more sheets can be processed into finished folded products and the output of a folding machine 1 (see FIGS. 3A, 3B and 4C) can be increased. As an alternative, the output of the folding machine 1 can be maintained and the transporting speed of the sheets 7*a*, 7*b* can be reduced, in particular when the material involved is difficult to process and requires a lower transporting speed in order to ensure a high quality of the products.

Figure 2A:
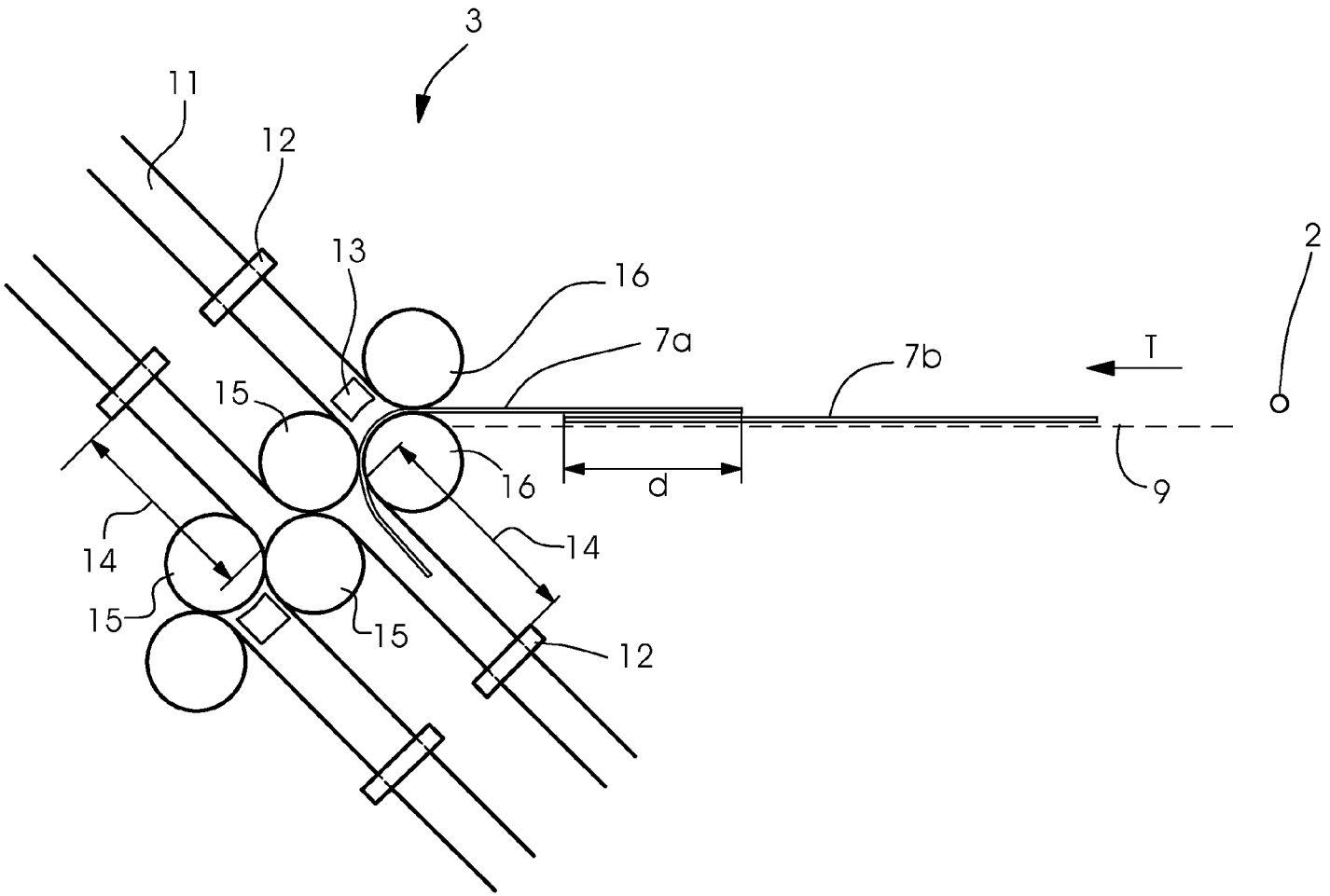
FIG. 2A is a fragmentary, longitudinal-sectional view showing a situation as a first sheet runs into a folding station.
Figure 2B:
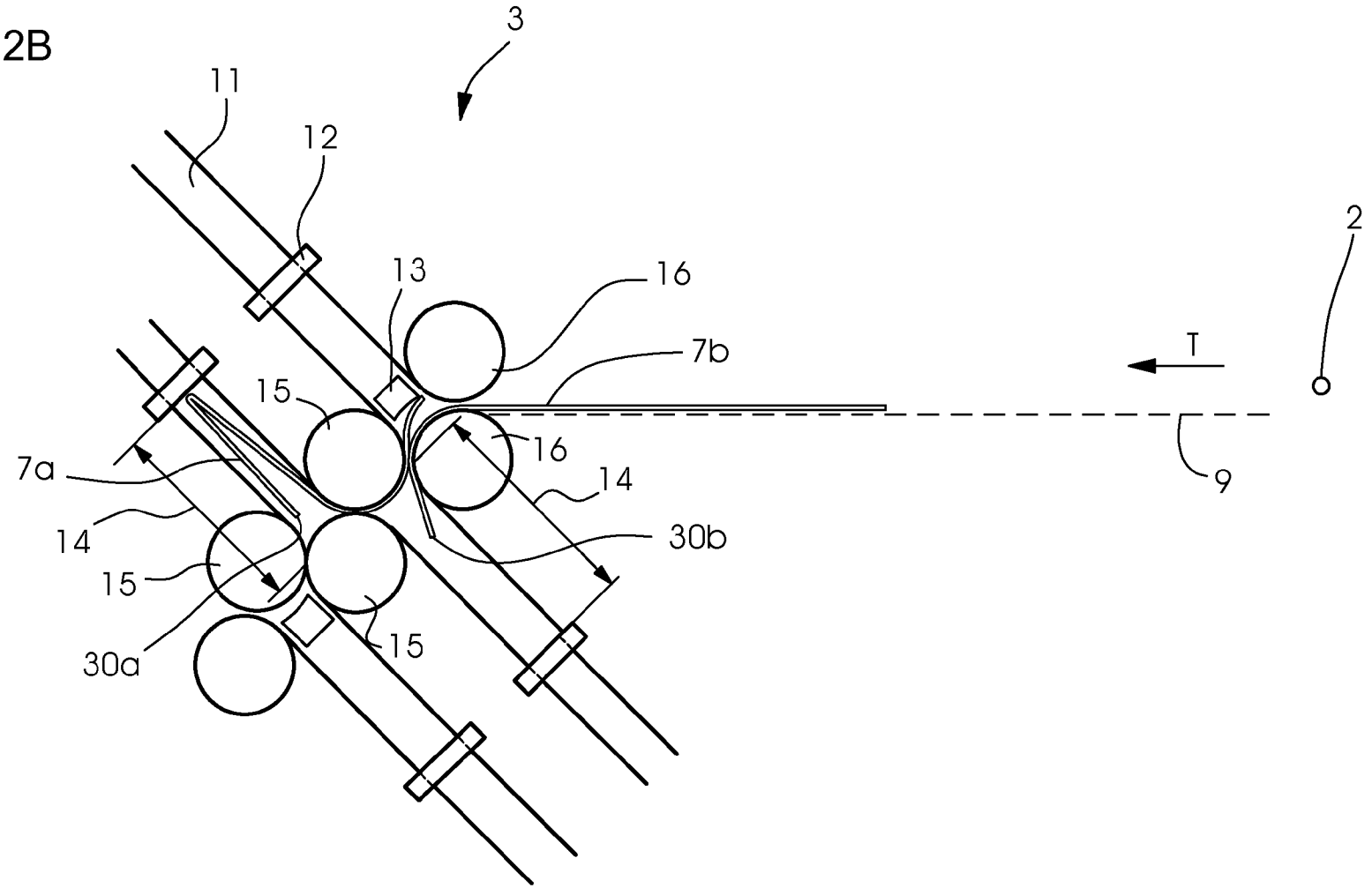
FIG. 2B is a view similar to FIG. 2A showing a situation as a second sheet runs into the folding station.
Figure 2C:
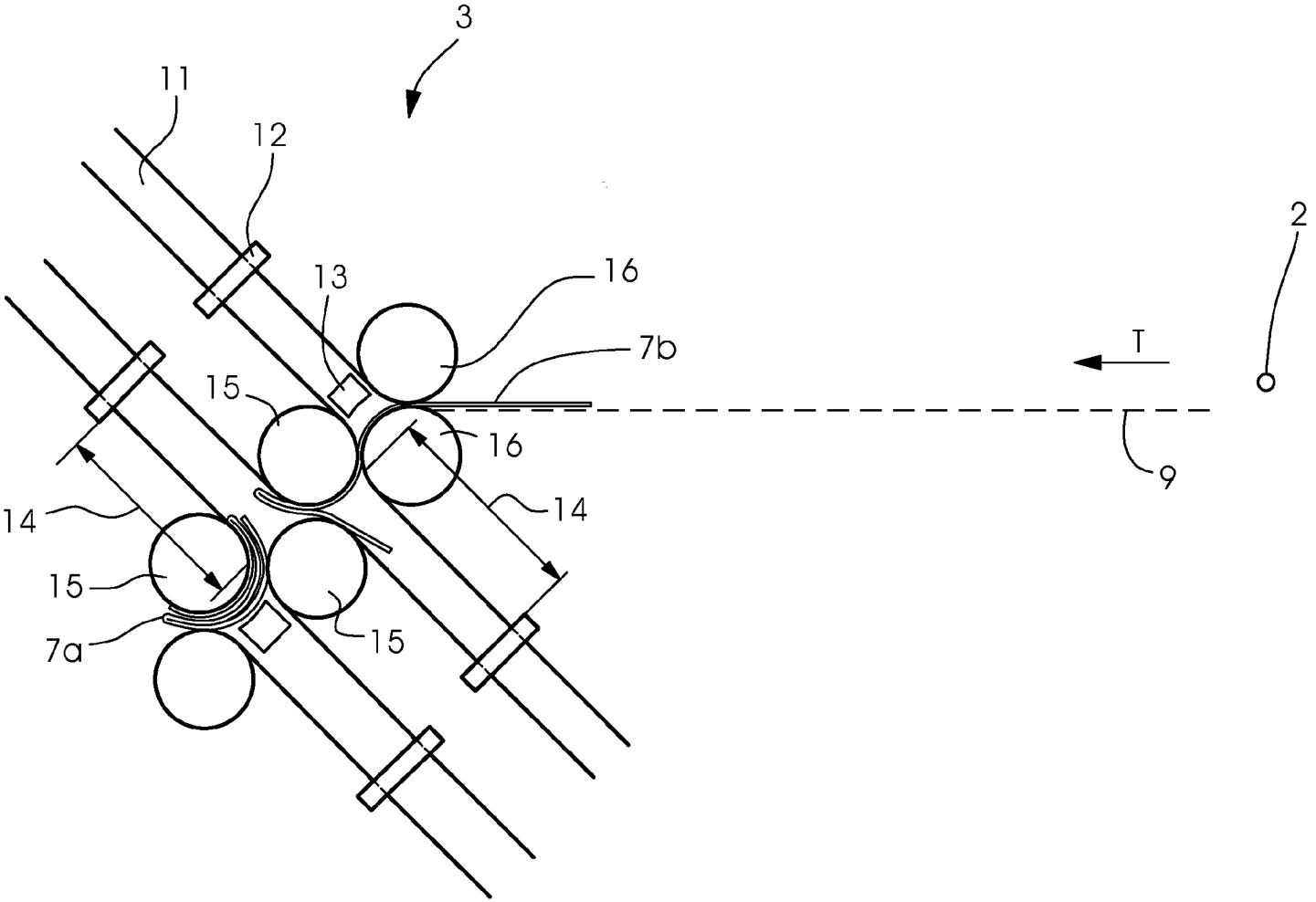
FIG. 2C is a view similar to FIGS. 2A and 2B showing a situation with both sheets in the folding station.

FIGS. 2A to 2C illustrate how the underlapping sheets 7*a*, 7*b* are folded in buckle folding units of the first folding station 3. FIG. 2A illustrates a first moment in time. The sheets 7*a*, 7*b* are fed from the feeder 2, over a feed table 9, to the first folding station 3 in the transporting direction T. The sheets 7*a*, 7*b* in this case have the underlapping d. The first sheet 7*a* has already been transported past a first, upper buckle plate 11 into a second, lower buckle plate 11. A sheet diverter 13 in this case prevents the first sheet 7*a* from running into the first buckle plate 11. A stop 12 of the second buckle plate 11 has been fed to an infeed length (folding length) 14. The infeed length 14 corresponds to a third of the length of the sheets 7*a*, 7*b*. FIG. 2B illustrates a second moment in time. The first sheet 7*a* has already left the second buckle plate 11, with a first fold having been produced by folding rollers 15. The first sheet 7*a* is already located in a third, upper buckle plate 11. The second sheet 7*b* is just running into the second, lower buckle plate. The setting shown for the infeed lengths 14 of the buckle plates 11 and the magnitude of the underlapping d ensure that the sheets 7*a* and 7*b* do not meet in the first folding station 3 in such a way as to result in relative speeds between the first sheet 7*a* and the second sheet 7*b*. For this purpose, the fold results in a leading edge 30*a* of the first sheet 7*a* being placed in such a position that it has a spacing of greater than zero from the leading edge 30*b* of the following, second sheet 7*b*. In a region downstream of the first buckle plate 11, between a transporting roller 16 and the folding roller 15, the first sheet 7*a* and the second sheet 7*b* are in contact, but are nevertheless moved at the same speed. The lack of relative speed between the first sheet 7*a* and the second sheet 7*b* prevents marking. FIG. 2C illustrates a third moment in time. The first sheet 7*a* has already been folded to completion and is being discharged from the first folding station 3. A first fold is just being produced in the second sheet 7*b* by the folding rollers 15. In this case too, the first sheet 7*a* and the second sheet 7*b* do not meet and there is no relative movement between the two sheets 7*a*, 7*b*.

According to FIGS. 2A-2C, the folding station 3 has four buckle folding units. According to the invention, however, the number of folding units can be varied as desired.

Figure 3A:
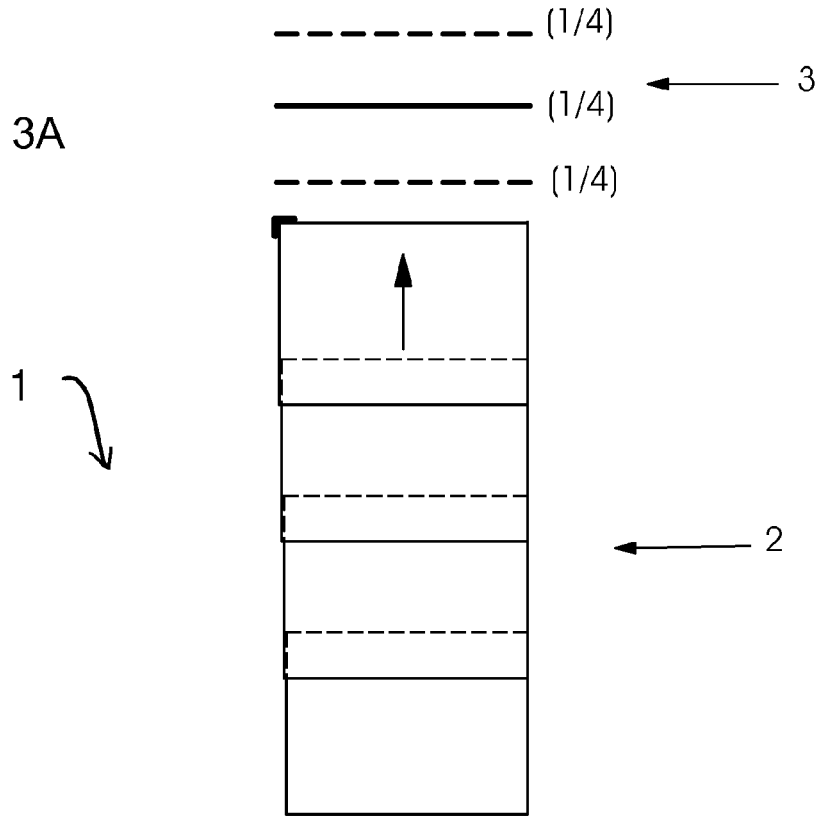
FIG. 3A is a plan view showing a first possible folding-unit configuration.

FIG. 3A illustrates a possible construction of a folding machine 1. The folding machine 1 has an imbricated feeder 2 and a following first folding station 3. The folding station 3 is a buckle folding station with at least three buckle plates. The infeed lengths of the respective buckle plates are indicated in parentheses and relate to the length of a respectively incoming sheet. The sheets are fed to the folding station 3 from the imbricated feed with underlapping. In the folding station, three zigzag folds are produced, with the first zigzag fold being produced in the first, lower buckle plate. The folding station 3 illustrated in FIG. 3A has three buckle plates 11. According to the invention, however, the folding station 3 could have any desired number of buckle plates 11.

Figure 3B:
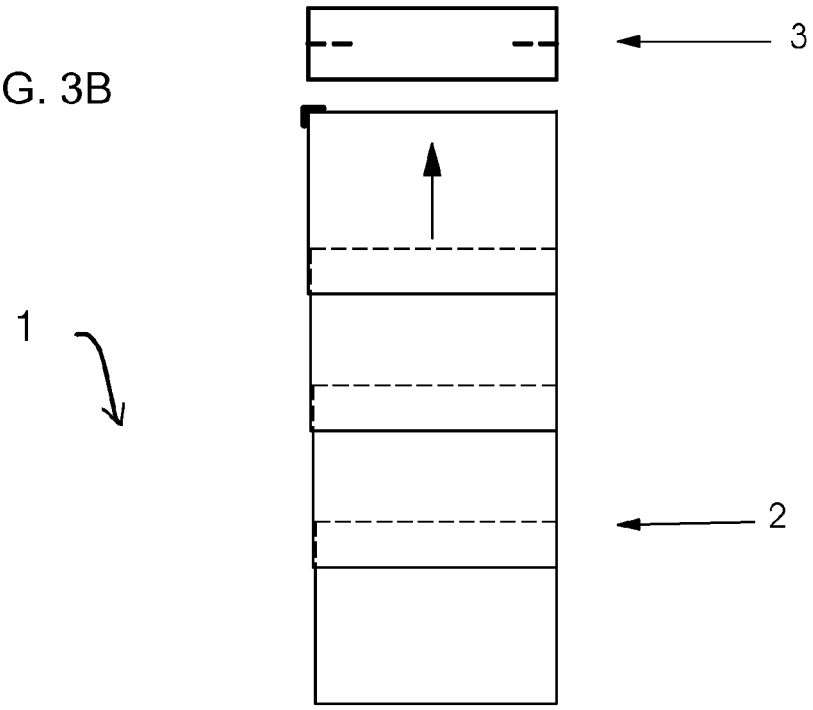
FIG. 3B is a plan view showing a second possible folding-unit configuration.

FIG. 3B illustrates a further possible construction of a folding machine 1. The folding station 3 in this case is configured as a parallel knife folding station with a knife which acts from below. In order for it to be possible to execute a plurality of parallel folds in this station, the illustrated parallel knife folding unit may be followed by further parallel knife folding units or buckle folding units.

Figure 4A:
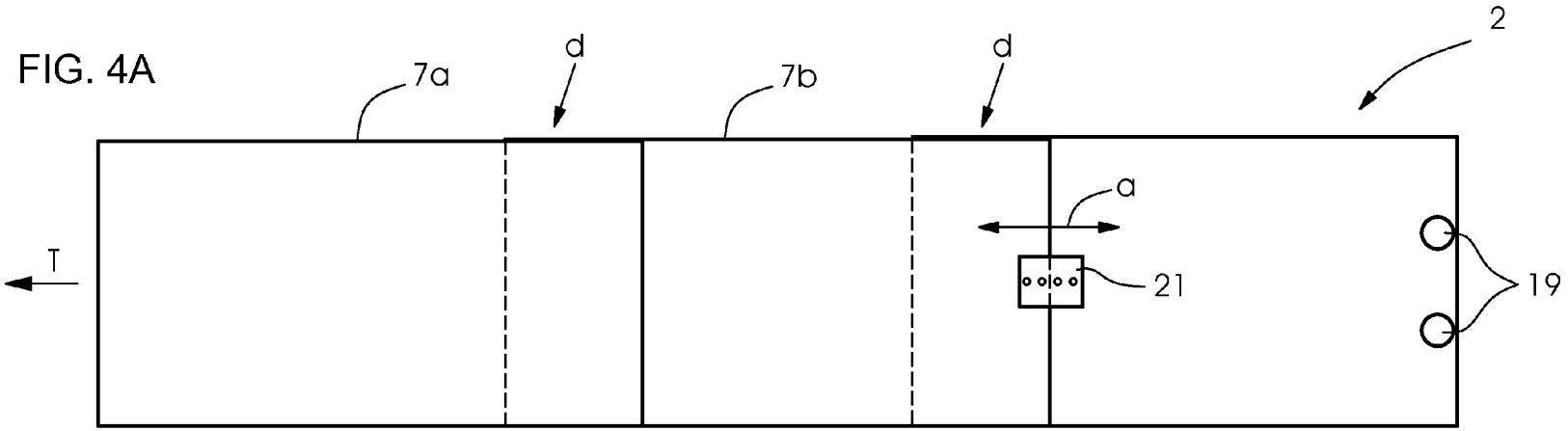
FIG. 4A is a plan view showing a region of the feeder.
Figure 4B:
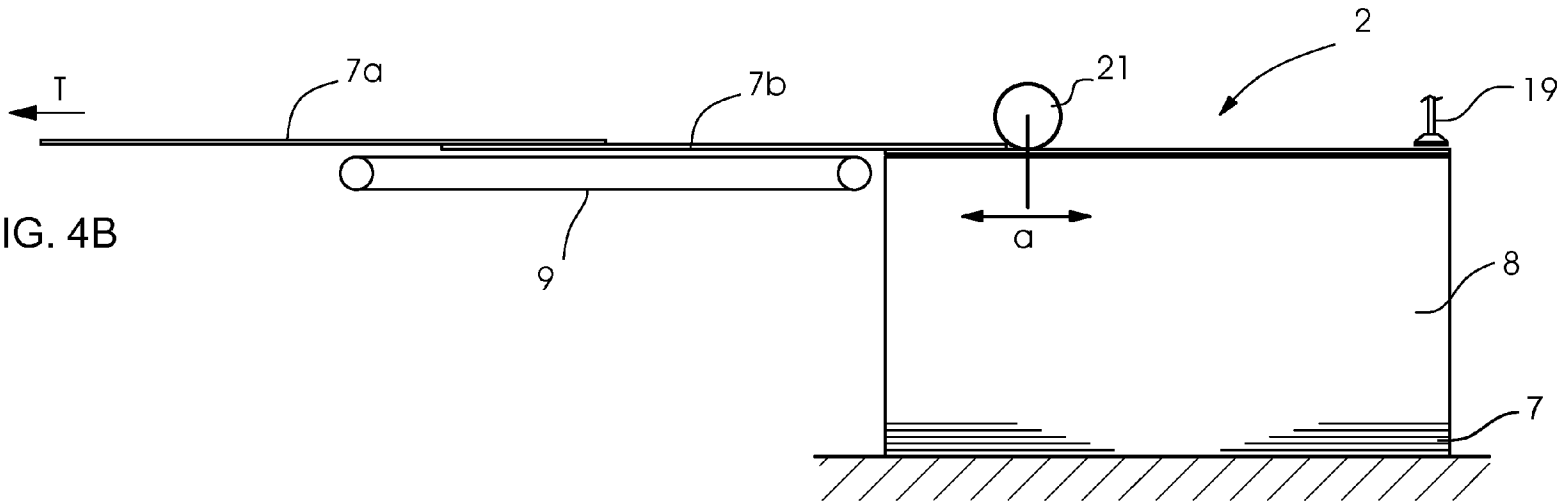
FIG. 4B is a side-elevational view showing the region of the feeder.
Figure 4C:
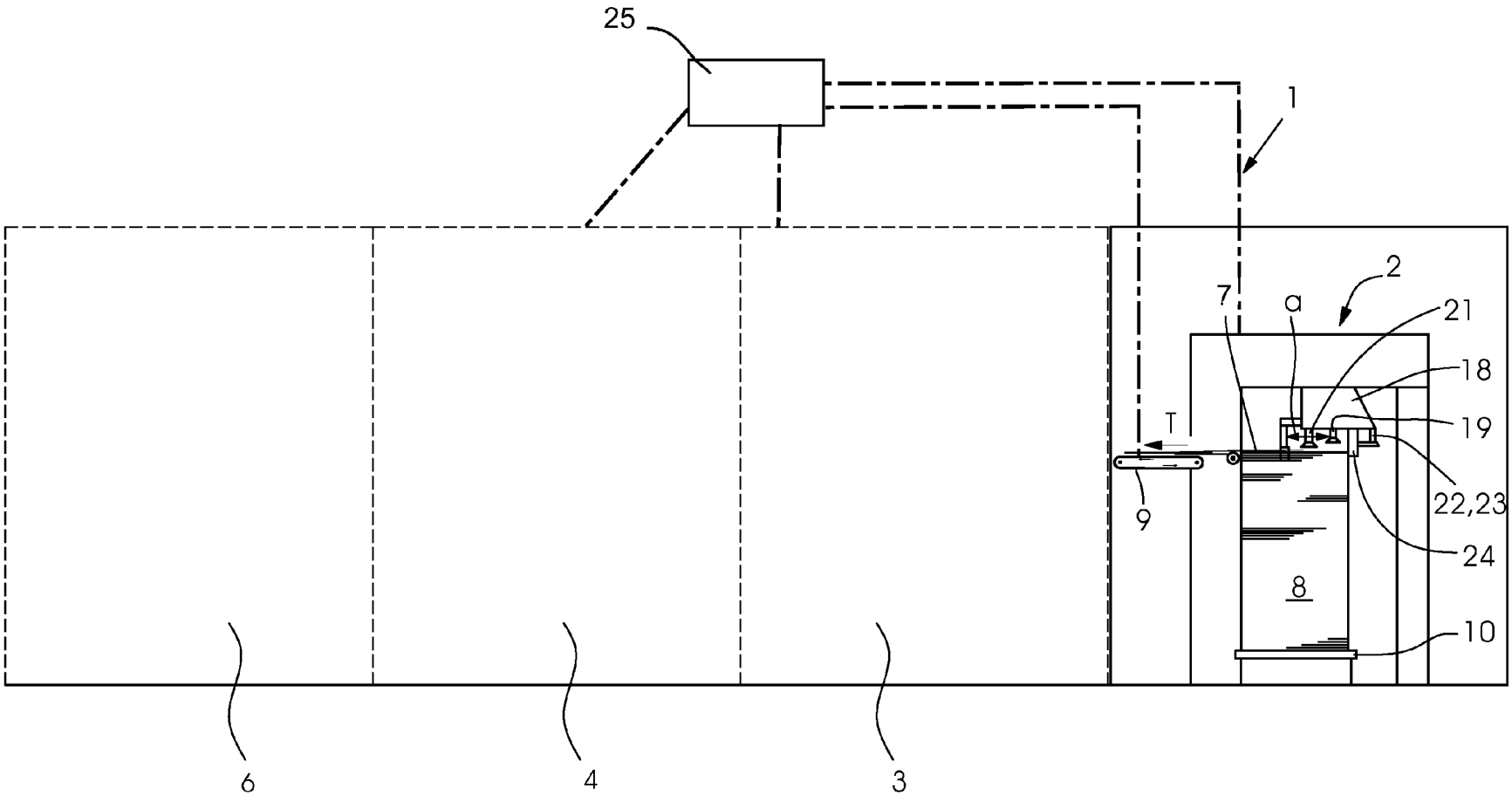
FIG. 4C is a side-elevational view showing a possible embodiment of a feeder.

FIGS. 4A to 4C illustrate the imbricated feeder 2, the separation of sheets 7, 7*a*, 7*b* and the underlapping removal of the sheets 7, 7*a*, 7*b*.

Sheets 7 located on a sheet stack 8 are raised individually by a lifting sucker 19 in the region of their upstream end. A suction roller 21 transfers the separated sheets 7 in the transporting direction T to a downstream feed table 9. The suction roller 21 in this case can be adjusted in and counter to the transporting direction T, as illustrated by a double arrow a. The position of the suction roller 21 in this case determines the degree of underlapping d. In the example illustrated in FIG. 4A and FIG. 4B, the spacing between the center of the suction roller 21 and the upstream leading edge of the sheet stack 8 is of the magnitude d. This also corresponds to the underlapping of the sheets 7*a* and 7*b*.

FIG. 4C illustrates an alternative exemplary embodiment of an imbricated feeder 2. A folding machine 1 for processing sheets 7 has an imbricated feeder 2, at least one buckle folding station 3, possibly a further folding station 4 and a delivery 6. The sheets 7 are removed from a sheet stack 8 and fed in imbricated form to the first buckle folding unit of the folding station 3 over a feed table 9. The sheet stack 8 rests on a stacking panel 10 which can be raised in a controlled manner. The sheets 7 are removed from the top side of the sheet stack 8 through the use of a so-called suction head 18 which has, inter alia, a number of lifting and pulling suckers 19, 21 for separating the sheets 7. Also provided are a blowing device 22 for loosening the top sheets and follower elements 23 for stack adjustment. A number of lateral and rear stops 24 are provided in order to align the sheet stack 8, in particular the top sheet 7 of the sheet stack 8. Finally, the aligning table 9 may be or include a transporting device for transporting the sheets 7, 7*a*, 7*b* and a common control unit 25 may be provided for activating the feeder 2, the at least one folding station 3, 4 and the transporting device 9.

The invention can be used to produce a wide variety of different signatures in dependence on the paper format and the machine configuration, and by way of different underlapping formations, as follows:

For example, in the first folding station, a 32-page signature can be produced by triple zigzag folding and subsequent double central folding with underlapping of not more than ¼, a 12-page signature can be produced by double zigzag folding and subsequent central folding with underlapping of not more than ⅓, a 24-page signature can be produced by double zigzag folding and subsequent double central folding with underlapping of not more than ⅓, and an 18-page signature can be produced by double zigzag folding and subsequent double parallel folding with underlapping of not more than ⅓. The information with respect to underlapping relates in each case to the first folding station.

The listing herein is not to be understood as being exhaustive, but rather should illustrate the variety of possibilities for applying the invention. Underlapping of ¼ is illustrated in FIG. 1B, while FIG. 2A shows underlapping of ⅓.

The underlapping in this case can be produced by different types of feeders, for example by pallet feeders, which are illustrated in FIG. 4, or else by flat pile feeders or rotary pile feeders.

The invention claimed is:

1. A method of folding sheet-like elements in a folding machine having a folding station with at least one folding unit, the method comprising the following steps:

feeding the sheet-like elements to the folding station in a transporting direction with leading edges of the sheet-like elements in front, with trailing edges of the sheet-like elements in back and with underlapping of the leading edges of the trailing sheet-like elements under the trailing edges of the leading sheet-like elements;

folding the sheet-like elements downward with a first folding length in the at least one folding unit;

producing a fold transversely to the transporting direction and creating a first folded product;

keeping the leading edge of the first folded sheet-like element ahead of or aligned with the leading edge of a following sheet-like element in the transporting direction in each case;

adjusting the underlapping to correspond at most to the first folding length; and wherein the sheets are prevented from meeting with relative movement between the sheets.

2. The folding method according to claim 1, wherein the at least one folding unit is a buckle folding unit.

3. The folding method according to claim 1, wherein the at least one folding unit is a parallel knife folding unit.

4. The folding method according to claim 1, which further comprises processing the first folded product further by subsequent further folding.

* * * * *